US006470087B1

(12) United States Patent
Heo et al.

(10) Patent No.: US 6,470,087 B1
(45) **Date of Patent: *Oct. 22, 2002**

(54) DEVICE FOR REPRODUCING MULTI-CHANNEL AUDIO BY USING TWO SPEAKERS AND METHOD THEREFOR

(75) Inventors: Jung-Kwon Heo, Seoul (KR); Young-Nam Oh, Seongnam (KR)

(73) Assignee: Samsung Electronics Co., Ltd., Suwon (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/946,881

(22) Filed: Oct. 8, 1997

(30) Foreign Application Priority Data

Oct. 8, 1996 (KR) ..... 96-44563

(51) Int. Cl.[7] ..... H04R 5/00

(52) U.S. Cl. ..... 381/17; 381/1; 381/27; 381/18

(58) Field of Search ..... 381/18, 17, 1, 381/19, 22–23, 27, 119, 310; 704/200.1, 500, 501

(56) References Cited

U.S. PATENT DOCUMENTS 5,400,433 A * 3/1995 Davis et al. ..... 395/2.29
5,459,790 A * 10/1995 Scofield et al. ..... 381/25
5,579,396 A * 11/1996 Iida et al. ..... 381/18
5,768,394 A * 6/1998 Heo ..... 381/1
5,867,819 A * 2/1999 Fukuchi et al. ..... 704/501

FOREIGN PATENT DOCUMENTS

| | | |
|---|---|---|
| JP | 52-124301 | 10/1977 |
| JP | 06-315200 | 11/1994 |
| JP | 08-182097 | 7/1996 |

* cited by examiner

*Primary Examiner*—Xu Mei
(74) *Attorney, Agent, or Firm*—Staas & Halsey LLP

(57) ABSTRACT

A device and a method for reproducing a multi-channel audio signal with only two speakers preserving the sound field of multi-channel audio reproduction, thereby providing vivid realism to a user (listener). The device for reproducing multi-channel audio to thereby provide vivid realism to a user by using two speakers includes a data restorer to decode a received multi-channel audio signal and to restore the multi-channel audio data of a frequency domain; a directivity preserving processor which has a center channel direction function and a stereo surround channel direction function based on a head related transfer function indicative of the characteristic of the frequency variation due to the head of the user for audio signals of center and stereo surround directions, to mix the center channel audio data and the stereo surround channel audio data multiplied by the direction function with left and right main channel audio data, and to output directivity-preserved left and right main channel audio data to two main channels; and a process domain converter to convert the directivity-preserved left and right main channel audio data into audio data of a time domain.

33 Claims, 6 Drawing Sheets

DEVICE FOR REPRODUCING MULTI-CHANNEL AUDIO BY USING TWO SPEAKERS AND METHOD THEREFOR

BACKGROUND OF THE INVENTION

1. Field of the Invention

The present invention relates to a multi-channel audio reproducing device and, more particularly, to a device for reproducing multi-channel audio data using two speakers and a method therefor.

2. Description of the Related Art

Endless tries to more rapidly and more exactly transmit all kinds of information, the amount of which has explosively increased in the multimedia times, result in a striking development of recent digital communication technique and in coupling of a highly integrated semiconductor (VLSI) and a signal processing technique (DSP). More still, conventionally, video, audio, and other data which have been produced and processed separately can be processed and used without a difference of information source or information media as very different formats. In this tendency, it appears that an international transmission standard of the digital data should be dispensably standardized to smoothly transmit and share the information between different types of equipment. As a result, standardization, for example, H.261 of ITU-TS in 1990, JPEG (joint picture expert group) of ISO/ITU-TS for storing and transmitting still pictures in 1992, and MPEG (moving picture expert group) of ISO/IEC was created.

Using a technique tendency of a present audio compression encoder, a wideband audio signal just like audio or music, requires much memory and a large bandwidth depending upon an increase of the volume of the data upon digitalization, storage, and transmission. To solve the above problems, many methods have been developed which are capable of encoding the audio signal, transmitting or storing the encoded signal after compression, and restoring the transmitted or stored signal as the audio signal having such an error that human beings can not recognize the same. In recent times, studies for more effectively reproducing an audio signal have being actively developed by decoding and encoding the audio signal while forming a mathematical psychoacoustic model using the auditory features of human beings. A method used for the above studies is based on the fact that in the auditory structure of human beings, the sensibility and the audible limit of recognizing a signal depending upon each frequency bandpass are different dependent upon each individual human being, and also based on the fact that the masking effect that a signal having a weaker energy than the signal having stronger energy in any frequency bandpass, can not be heard due to the signal having the stronger energy, where the signal having the weaker energy is positioned adjacent to the signal having the stronger energy. In accordance with the development of the studies of decoding and encoding all kinds of audio signals as described above, the international standardization of the ISO MPEG has been developed for the method of encoding and decoding the audio signal used in recent digital audio equipments and multimedia, the MPEG1 audio standard has been confirmed for stereo broadcasting in 1993, and the MPEG2 audio standardization has being developed at present for 5.1 channels ("0.1" meaning the subwoofer channel and MPEG provides a separate processing routine for the subwoofer channel). The AC3, as an independent compression algorithm of the Dolby Co. in the U.S. and centering around the recent U.S. movie industry, was determined for the high definition television (HDTV) digital audio standards of the U.S. in November, 1993, which will become one of the MPEG standard for international sharing.

These algorithms, for example, MPEG2 and AC3, play the roles of compressing the multi-channel audio data at a low transmission speed, which are adapted as the standard of the algorithm in the HDTV and DVD, so that people in a house can hear the same sound as heard in the theater. However, at least five speakers for hearing the multi-channel audio data using the above algorithm and five amps for driving these speakers are required. Actually, it is hard to include such equipment in a person's house. Therefore, not everyone can enjoy the multi-channel audio effect therein. If the compressed multi-channel audio can be reproduced as the audio of two channels using a conventional down-mixing, the direction component of the multi-channel audio disappears, thereby providing vivid realism to listeners.

In the meanwhile, although the Dolby Pro-logic 3D-phonic algorithm invented by the Victor Co., Ltd. in Japan down-mixes the multi-channel audio signal as two channels and reproduces the down-mixed signal, it has an effect on hearing the audio as four channels.

FIG. 1 is a diagram to explain a Dolby Pro-Logic 3D-Phonic algorithm developed by the Victor Co., Ltd, in Japan. With reference to FIG. 1, reference numeral 2 indicates a processor including a Dolby Pro-Logic unit 10, and a 3D-phonic processor 12. Also, a left outputter 4 includes a left amp (LAMP) 14 and a left speaker (LSP) 16, and a right outputter 6 includes a right amp (RAMP) 18 and a right speaker (RSP) 20. Specially, FIG. 2 is a detailed circuit diagram showing the 3D-phonic processor 12 of FIG. 1.

Referring to FIGS. 1 and 2, an explanation of the operation of the algorithm will be given as follows. In FIG. 1, audio signals IL and IR of two channels to be received are changed into audio signals of four channels, that is, a left signal, a right signal, a center signal, and a surround signal (L,R,C,S) and the changed signals are applied to the 3D-phonic processor 12. In FIG. 2, regarding the operations of the 3D-phonic processor 12, the left audio signal L and the right audio signal R are respectively input to a left adder 30 and a right adder 32, the center audio signal C is commonly input to the above left and right adders 30 and 32, and the surround audio signal S is also input altogether to the above left and right adders 30 and 32 after being processed according to the 3D-phonic algorithm 34 of FIG. 2, so that the sound heard by people appears to be generated from the behind. Consequently, the left and right audio signals eL and eR including the center and surround directivity components in the left and right adders 30 and 32 are applied to the left and right lamp 14 and ramp 16, separately. Therefore, a listener can hear the audio of four channels through the left and right speakers LSP 16 and RSP 20.

However, the method of using the Dolby Pro-Logic 3D-phonic algorithm developed by the Victor Co., Ltd. in Japan has a problem in that the calculation amount is increased because the filtering for 3D-phonic and all data processing are performed only in a time domain. In addition, many signal processing devices should be equipped to quickly process the above calculation amount.

SUMMARY OF THE INVENTION

It is an object of the present invention to provide a device and a method for reproducing a multi-channel audio signal with only two speakers preserving the sound field of multi-channel audio reproduction.

It is another object of the present invention to provide a device and a method for preserving each directivity component of the multi-channel audio signal in a frequency domain.

It is a further object of the present invention to provide a device and a method for reducing the calculation amount generated when reproducing the multi-channel audio signal by using only two speakers.

The foregoing and other objects of the present invention are achieved by providing a device for reproducing multi-channel audio data to thereby provide vivid realism to a user just as multi-channel by using two speakers, including a data restorer to decode a received multi-channel audio signal and to restore the multi-channel audio data of a frequency domain; a directivity preserving processor which has a center channel direction function and a stereo surround channel direction function based on a head related transfer function indicative of the characteristic of the frequency variation due to the head of the listener for audio signals of center and stereo surround directions, to mix the center channel audio data and the stereo surround channel audio data multiplied by the direction function with left and right main channel audio data, and outputting directivity-preserved left and right main channel audio data to two main channels; and a process domain converter to convert the directivity-preserved left and right main channel audio data into the data of a time domain.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT(S)

Figure 1:
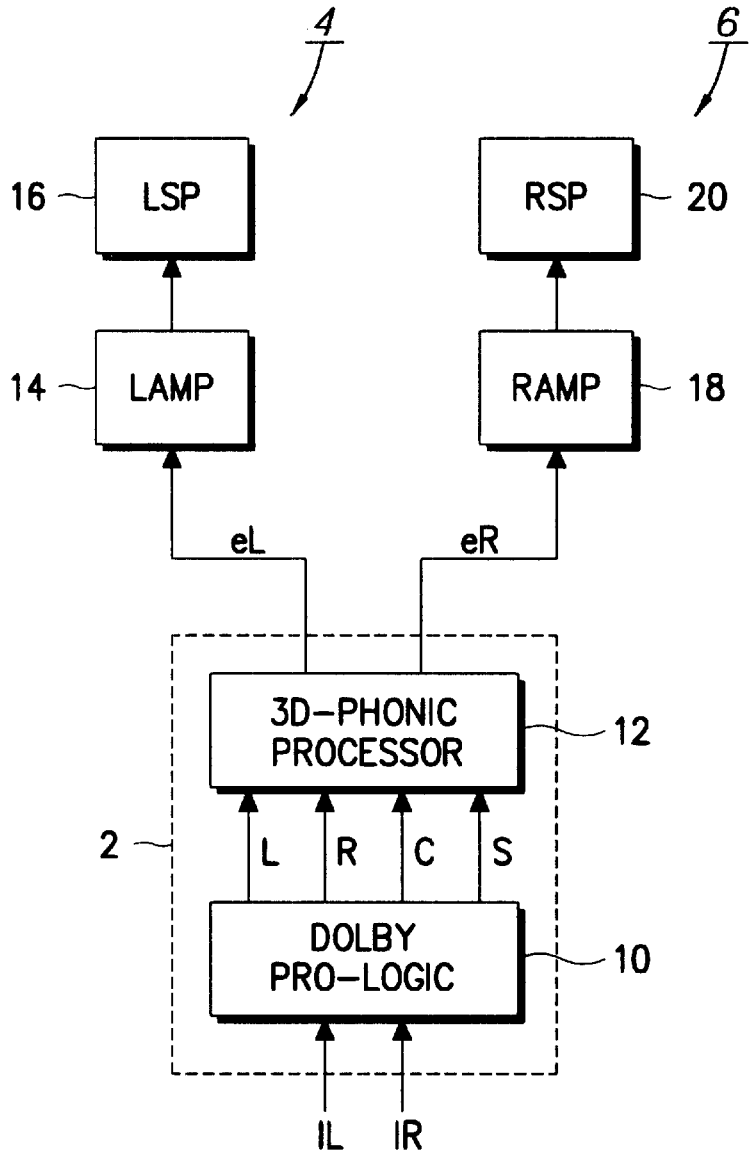
FIG. 1 PRIOR ART
FIG. 1 is a diagram for explaining a Dolby Pro-Logic 3D-Phonic algorithm developed by the Victor Co., Ltd, in Japan.

Hereinafter, a preferred embodiment of the present invention will be concretely explained with reference to the accompanying drawings. Most of all, throughout the drawings, it is noted that the same reference numerals or letters will be used to designate like or equivalent elements having the same function. Further, in the following description, numeral specific details such as concrete components composing the circuit and the frequency, are set forth to provide a more thorough understanding of the present invention. It will be apparent to one skilled in the art, however, that the present invention may be practiced without these specific details. The detailed descriptions of known functions and devices which unnecessarily obscure the subject matter of the present invention will be avoided in the detailed description of the present invention.

Figure 3:
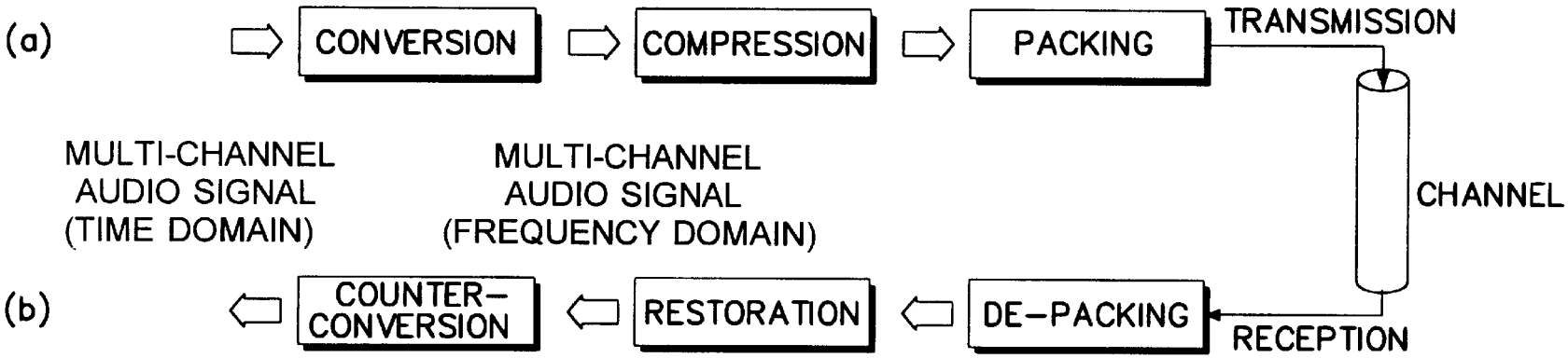
FIG. 3 is a schematical diagram for explaining processes for encoding and decoding an audio signal according to an embodiment of the present invention.

FIG. 3 is a schematical diagram explaining the processes for encoding and decoding an audio signal according to an embodiment of the present invention, wherein the top portion of FIG. 3, denoted by (a), indicates a process of encoding the audio signal by converting the multi-channel audio signal of the time domain generated in a mike into the multi-channel audio signal of the frequency domain, compressing and packing the converted signal, and transmitting the compressed and packed signal through the channel, and the bottom portion, denoted by (b) thereof, indicates a process of decoding the audio signal received through the channel, namely, the process of counter-converting the audio signal by de-packing, restoring and counter-converting the audio signal.

The reproduction device for reproducing the multi-channel audio signal using only two speakers according to an embodiment of the present invention relates to de-packing and restoring processes of the decoding processes shown in bottom portion (b) of FIG. 3. It is noted that the de-packing and restoring processes process the data in the frequency domain.

Figure 4:
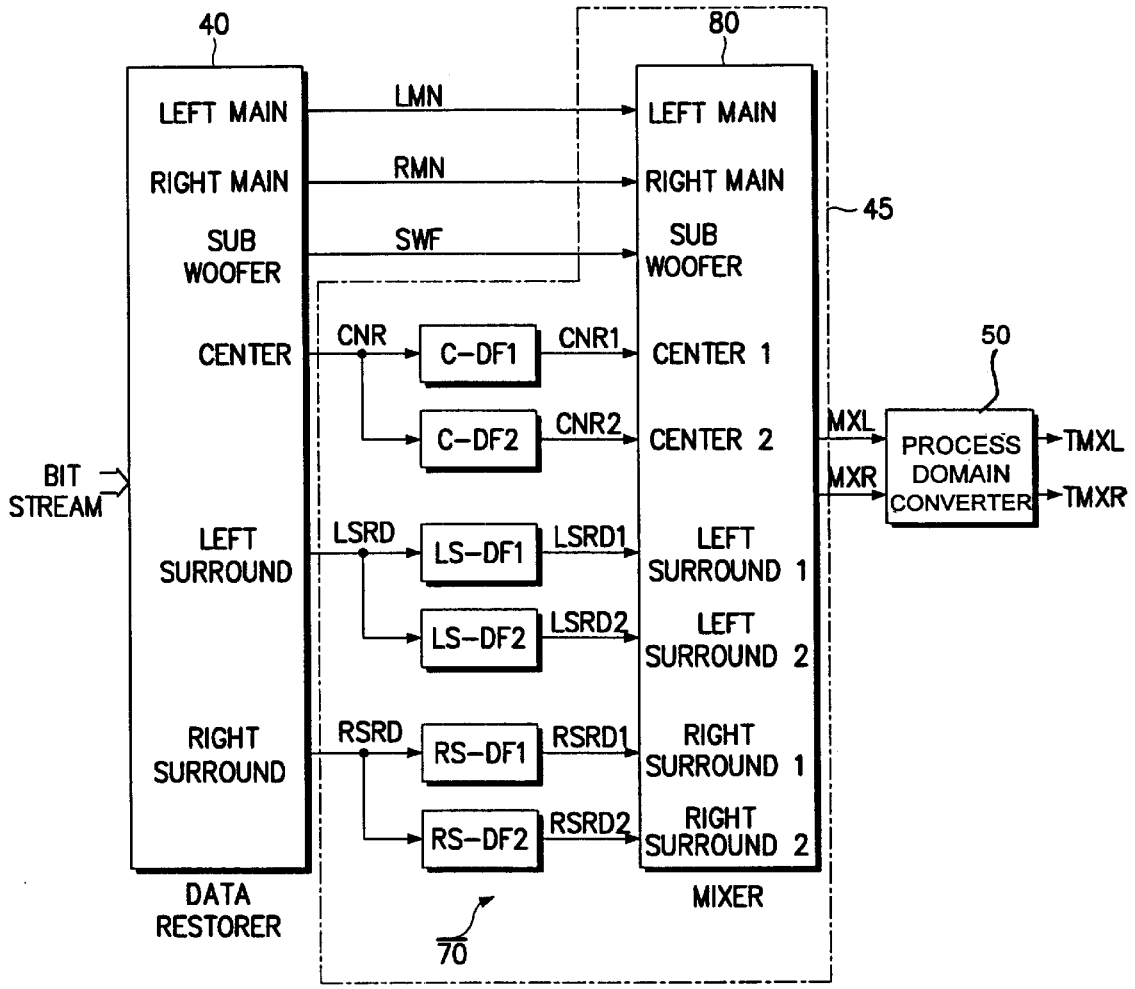
FIG. 4 is a block diagram of a device to reproduce multi-channel audio data according to the embodiment of the present invention.
Figure 5:
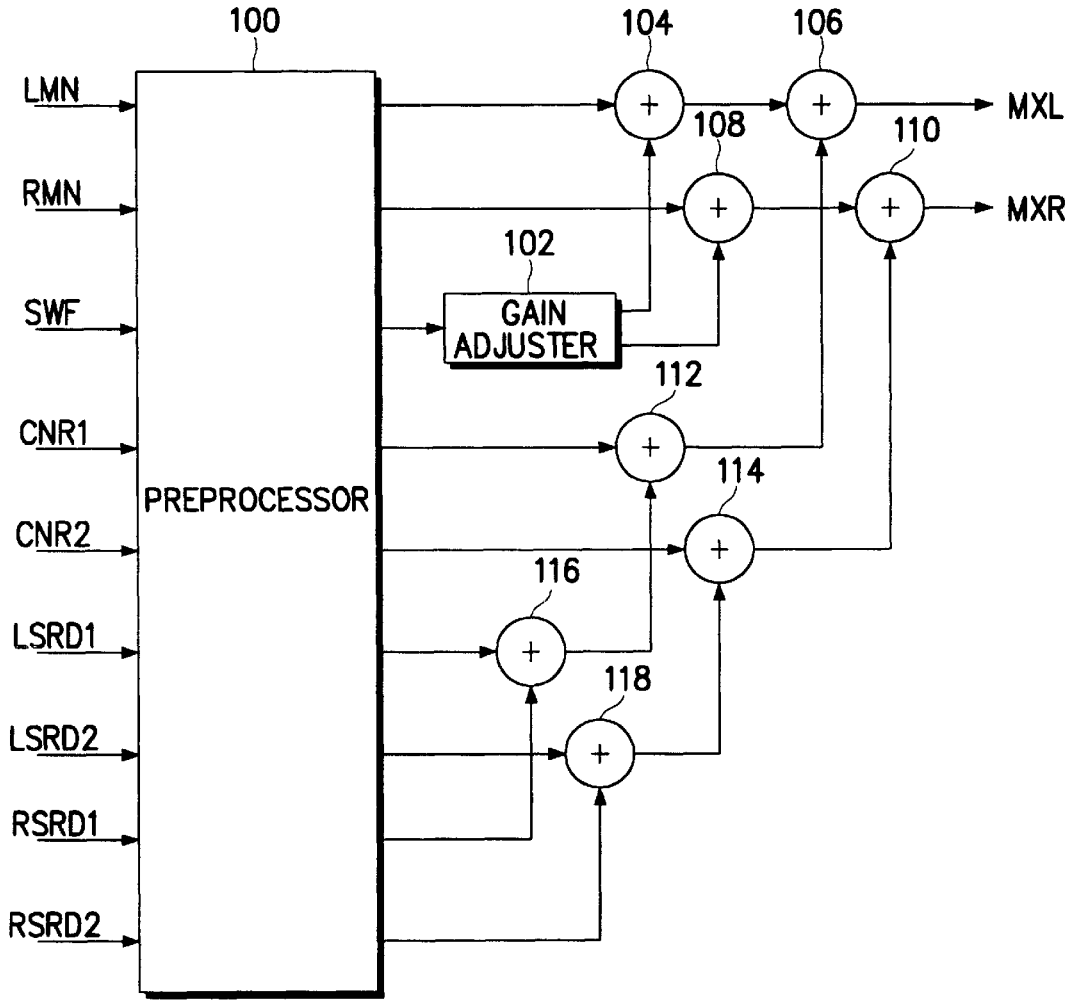
FIG. 5 is a detailed block diagram showing a mixer of a directivity preserving processor shown in FIG. 4.

FIG. 4 is a block diagram of a device to reproduce multi-channel audio data according to the embodiment of the present invention, which corresponds to the de-packing and restoring process and includes a data restorer 40, a directivity preserving processor 45, and a process domain converter 50. FIG. 5 is a detailed block diagram showing a mixer 80 of the directivity preserving processor 45 of FIG. 4.

Regarding FIG. 4, the data restorer 40 decodes the received multi-channel audio signal by using an MPEG2 or AC3 algorithm and restores the decoded signal as the multi-channel audio data of the frequency domain. The directivity preserving processor 45 obtains a center channel direction function and a surround stereo channel direction function based upon the head related transfer function indicative of characteristics of the frequency variation due to the listener's head relating to the audio signal of the center and surround stereo directions, adds the obtained two direction functions to the audio data of two main channels, and outputs the added data to the two main channels. The process domain converter 50 converts the directivity preserved-processed audio data of the two main channels into the data of the time domain.

Now, a bit stream (multi-channel audio signal) encoded with an algorithm such as MPEG2 or AC3 is applied to the data restorer 40. The data restorer 40 restores the coded bit stream as the data of the frequency domain using an algorithm such as the MPEG2 or AC3. The audio data of the frequency domain restored at the data restorer 40 is output through a left main channel, a right main channel, a subwoofer terminal, a center channel terminal, a left surround channel terminal, and a right surround channel terminal because of being in the multi-channel, respectively.

The two main channel audio data are the left/right main channel audio data LMN and RMN output in the left main channel terminal and the right main channel terminal. The above left/right main channel audio data LMN and RMN are directly applied to the mixer 80 of the directivity preserving processor 45. The subwoofer audio data SWF output in the subwoofer terminal as the data necessary for generating the effect sound below 200 Hz, is also applied to the mixer 80.

The center channel audio data CNR, the left surround channel audio data LSRD, and the right surround channel audio data RSRD, which are output through the center channel terminal, the left surround channel terminal and the right surround channel terminal, respectively, are applied to the mixer 80 of the directivity preserving processor 45 by being multiplied by direction functions preset in the direction function unit 70.

In the direction function unit 70, direction functions C-DF1 and C-DF2 indicate the direction functions for the center channel audio data CNR among the data of the frequency domain and direction functions LS-DF1 and LS-DF2 indicate the direction functions for the left surround channel audio data LSRD among the data of the frequency domain. Additionally, RS-DF1 and RS-DF2 are represented as direction functions for the right surround channel audio data RSRD among the data of the frequency domain. DF1 is a direction function regarding a signal to be applied to the left speaker and DF2 is a direction function to be applied to the right speaker. C-DF1 and C-DF2 are direction functions for signals to be applied to the left and right speakers, respectively, for the virtual reproduction of the center speaker. LS-DF1 and LS-DF2 are direction functions for the signals to be applied to the left and right speakers, respectively, for the virtual reproduction of the left surround speaker. RS-DF1 and RS-DF2 are direction functions for the signals to be applied to the left and right speakers, respectively, for the virtual reproduction of the right surround speaker. Virtual reproduction occurs, for example, in an instance where there is no actual left surround speaker, but it feels to the listener that there exists a left surround speaker if the signal to be fed to the left surround speaker is processed through the LS-DF1 and the LS-DF2 direction functions and reproduced at the left and right speakers. The same is true from the virtual reproduction of the center and right surround speakers.

The above direction functions C-DF1, C-DF2, LS-DF1, LS-DF2, RS-DF1, and RS-DF2 indicate the direction functions set according to the embodiment of the present invention, to reproduce all of the multi-channel audio data by means of only two speakers. The foregoing direction functions are made on the basis of the HRTF (head related transfer function). The HRTF represents the characteristic that the frequency of the audio heard by a listener varies in each direction (for example, right, left, center, left or right surround) owing to the head of the listener. That is, it appears that the listener has one special filter regarding the specific direction. Therefore, the HRTF corresponds to filtering for the specific frequency domain among the frequency domains of the audio signal in case of hearing the audio signal of the special direction to the listener.

A method for obtaining the direction functions according to the embodiment of the present invention will be explained hereinafter with reference to FIG. 6.

Figure 6:
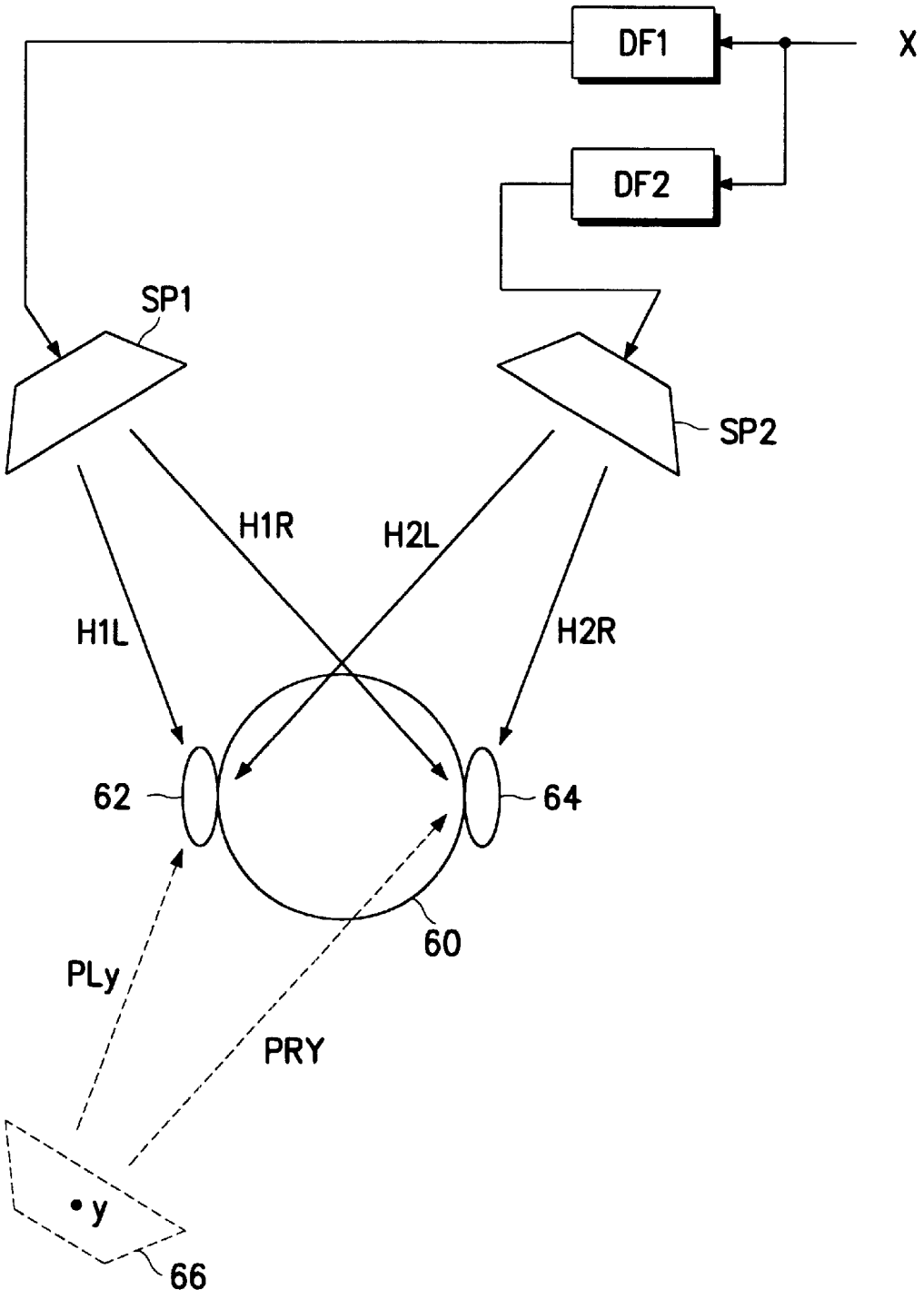
FIG. 6 is a diagram for explaining a method of determining a direction function according to the embodiment of the present invention.

FIG. 6 is a diagram for explaining a process of determining the direction functions according to the embodiment of the present invention. As an example, FIG. 6 explains the way to determine the direction functions of DF1 and DF2 of the left surround speaker (in other words, LS-DF1, LS-DF2). The other direction functions can be determined using the same method simply by changing the location of the speaker (center, right surround). In FIG. 6, reference number 60 represents the head of the listener, and reference numerals 62 and 64 represent the left and right ears of the listener, respectively.

Figure 2:
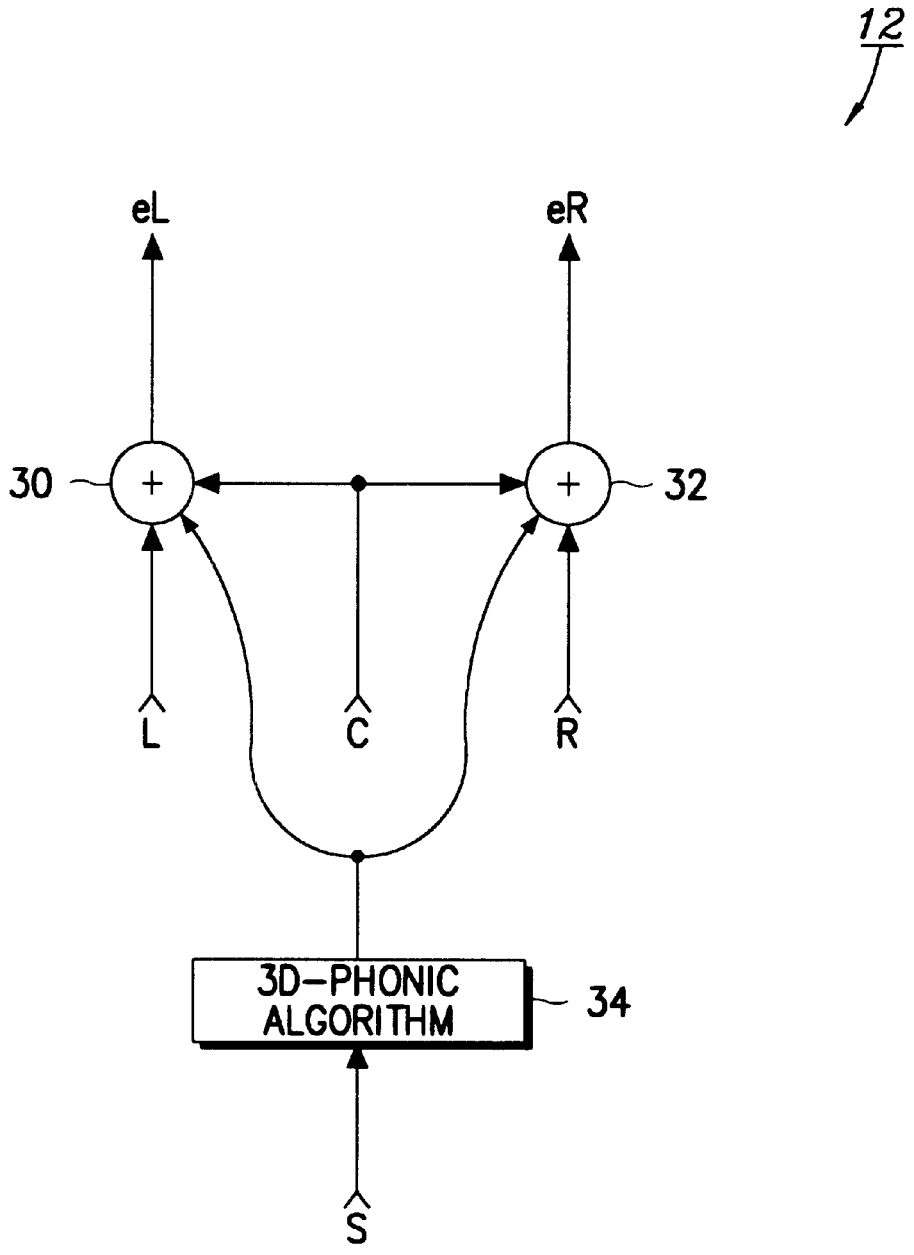
FIG. 2 is a detailed circuit diagram showing a 3D-phonic processor shown in FIG. 1.

With reference to FIGS. 2 and 6, signals eL and eR (input signals to the ear when the signal X is reproduced through the processing chain of front channels in this figure) reaching both ears 62 and 64 through the direction functions DF1 and DF2 will be expressed by the following expression 1.

$$eL=H1L*DF1*X+H2L*DF2*X$$

$$eR=H1R*DF1*X+H2R*DF2*X \qquad \text{Expression 1}$$

wherein X is a sound source, H1L and H1R are HRTFs regarding the left ear 62 and the right ear 64 of the listener in light of the left speaker SP1, H2L and H2R are HRTFs regarding the left and right ears 62 and 64 of the listener in light of the right speaker SP2, DF1 is a direction function relating to a signal to be applied to the left speaker SP1 and DF2 is a direction function relating to a signal to be applied to the right speaker SP2.

In the meantime, signals dL and dR (input signals to the ear when the signal X is reproduced at the position Y) reaching the sound source X at both ears 62 and 64 of the listener through a speaker 66 pseudo-set in an arbitrary position y can be expressed by the following expression 2.

$$dL=PLy*X$$

$$dR=PRy*X \qquad \text{Expression 2}$$

In the above expression 2, PLy and PRy are HRTFs regarding the left and right ears 62 and 64 of the listener in the above speaker 66.

Ideally, the above expressions 1 and 2 have to be equal to each other, that is, eL=dL, eR=dR. In the above expressions 1 and 2, since H1L, H1R, H2L and H2R as HRTF are obtained from experiments and the sound source X has an already-known value, the direction functions DF1 and DF2 for the pseudo-set speaker 66 located in the position y can be obtained using the relation (eL=dL, eR=dR) of the expressions 1 and 2. For instance, when observing that the pseudo-set speaker 66 is the left surround speaker, the direction functions DF1 and DF2 obtained in this case become transfer functions LS-DF1 and LS-DF2 related to the left surround channel audio data LSRD in the direction function unit 70.

The direction functions for the audio data of the center channel and the surround stereo channel (left surround channel and right surround channel) all can be obtained using the above method.

The center channel audio data CNR1, 2, the surround stereo channel audio data LSRD1, 2, and RSRD1, 2 (left surround channel and right surround channel) produced by being multiplied by the direction function in the direction function unit 70 are applied to the mixer 80 of the directivity preserving processor 45, are mixed respectively with the left main channel audio data LMN and the right main channel audio data RMN, and are output as the audio data MXL and MXR of two channels.

The construction of the mixer 80 of the directivity preserving processor 45 is as shown in FIG. 5. With reference to FIG. 5, the mixer 80 is included with a preprocessor 100, a gain adjuster 102, and a plurality of adders 104 through 118.

The preprocessor 100 performs pre-processing such as block switching dependent upon determination of the algorithm with input of the left/right main channel audio data LMN and RMN, the subwoofer audio data SWF applied from the data restorer 40, and with the input of the audio data CNR1, 2, LSRD1, 2, and RSRD1, 2 of first and second center channels, and the stereo surround channel (first and second left surround channels, and first and second right surround channels) applied through the direction function unit 70.

The subwoofer audio data SWF output from the preprocessor 100 has its gain adjusted by the gain adjuster 102, so as not to remove the signal of the left main channel audio data and the right main channel audio data, and are then applied to the adders 104 and 108. The adder 104 adds the gain-adjusted subwoofer audio data to the pre-processed left main channel audio channel and outputs the added data to the adder 106. Also, the first right surround channel audio data and the first left surround channel audio data preprocessed in the preprocessor 100 are added to each other in the adder 116. The output of the adder 116 is added to the pre-processed first center channel audio data in the adder 112, and the output of the adder 112 is applied to the adder 106. Accordingly, the adder 106 adds the outputs of the adders 112 and 104 to each other and outputs the mixed left channel audio data to the process domain converter 50.

In the meantime, the second right surround channel audio data and the second left surround channel audio data preprocessed in the preprocessor 100 are added to each other in the adder 118. The output of the adder 118 is added to the pre-processed second center channel audio data in the adder 114, and the output of the adder 114 is applied to the adder 110. The pre-processed right main channel audio data and the gain-adjusted subwoofer audio data are added to each other in the adder 108, and the result is added to the output of the adder 114 in the adder 110. Accordingly, the output of the adder 110 becomes the mixed right channel audio data. The mixed right channel audio data is outputted to the processes domain converter 50 of FIG. 4.

With regard to FIG. 5, two main channel audio data which have the preserved directivity by the mixing operation of the mixer 80 are applied to the process domain converter 50. The process domain converter 50 as illustrated in FIG. 4 converts the two main channel audio data having the preserved directivity into the data of the time domain TMXL and TMAR and thereby outputs the converted data.

As is apparent from the foregoing, in the case that the present invention is actually applied to real products, it is preferable to insert the above-described device into an audio decoder, thereby switching on/off the above function when the need arises by a user.

As stated hereinbefore, the present invention provides the vivid realism to the user by providing the directivity of each channel signal to the compressed multi-channel audio signal by using only two speakers. In addition, it has an effect on reducing the calculation amount required by performing calculation for the performance of the object of the present invention in the frequency domain.

Therefore, it should be understood that the present invention is not limited to the particular embodiment disclosed herein as the best mode contemplated for carrying out the present invention, but rather that the present invention is not limited to the specific embodiments described in this specification, except as defined in the appended claims.

What is claimed is:

1. A device for reproducing multi-channel audio data by using two speakers, comprising:

a data restorer to decode the multi-channel audio data and restore the multi-channel audio data of a frequency domain, wherein the multi-channel audio data of the frequency domain comprises left main channel, right main channel, subwoofer channel, a center channel, and stereo surround channel audio data;

a directivity preserving processor comprising a center channel direction function and a stereo surround channel direction function based on a head related transfer function indicative of a characteristic of frequency variation due to a head of a user for audio signals of center and stereo surround directions, wherein said directivity preserving processor multiplies the center channel audio data and the stereo surround channel audio data by the center channel and stereo surround channel direction functions, mixes the multiplied center channel audio data and the stereo surround channel audio data with the left and right main channel and subwoofer channel audio data, and outputs directivity-preserved left and right main channel audio data to two main channels; and a process domain converter to convert the directivity-preserved left and right main channel audio data into audio data of a time domain.

2. The device as claimed in claim 1, wherein said directivity processor comprises:

a direction function unit comprising the center channel and stereo surround channel direction functions for the center channel audio data and the stereo surround channel audio data, respectively, to multiply the center channel audio data and the stereo surround channel audio data by the corresponding direction functions and to output said multiplied data as first and second multiplied center channel audio data and as first and second stereo surround channel audio data; and a mixer to mix said left main channel and subwoofer channel audio data with said first center multiplied channel audio data and said first stereo surround channel audio data to generate the directivity-preserved left main channel audio data, and to mix said right main channel and subwoofer channel audio data with said second multiplied center channel audio data and said second stereo surround channel audio data to generate the directivity-preserved right main channel audio data.

3. The device as claimed in claim 2, wherein said mixer comprises:

a preprocessor to pre-process the left main channel, right main channel subwoofer channel, and subwoofer audio channel first and second multiplied center channel, and first and second stereo surround channel audio data, by block switching based upon an algorithm with which the multi-channel audio data is encoded; and an adding unit to add the preprocessed left main channel audio data and subwoofer channel to the preprocessed first multiplied center channel audio data and the preprocessed first stereo surround channel audio data to generate the directivity-preserved left main channel audio data, and the preprocessed right main channel and subwoofer channel audio data to the preprocessed second multiplied center channel audio data and the preprocessed second stereo surround channel audio data to generate the directivity preserved right main channel audio data.

4. The device as claimed in claim 2, wherein said directivity preserving processor processes the multi-channel audio data based upon a direction function in the frequency domain.

5. A method for reproducing multi-channel audio data by using two speakers, comprising the steps of:

decoding the multi-channel audio data and restoring the decoded multi-channel audio data of a frequency domain, where the multi-channel audio data comprises left and right main channel data, center channel audio data, and stereo surround channel audio data;

obtaining a center channel direction function and a stereo surround channel direction function based upon a head related transfer function indicative of a characteristic of frequency variation due to a head of a user for audio signals of center and stereo surround directions;

applying the obtained center channel direction function and stereo surround channel direction function to the center channel and the stereo surround channel audio data to produce applied center channel audio data and applied stereo surround channel audio data, respectively;

mixing the applied center channel audio data and the applied stereo surround channel audio data with left and right main channel audio data to generate directivity-preserved left and right main channel audio data to two main channels; and converting the directivity-preserved left and right main channel audio data into audio data of a time domain.

6. The method as claimed in claim 5, wherein each of the direction functions is obtained by relations of eL=dL, eR=dR in the following expressions:

$$eL=H1L*DF1*X+H2L*DF2*X$$

$$eR=H1R*DF1*X+H2R*DF2*X$$

wherein X is a sound source, H1L and H1R are head related transfer functions (HRTFs) relating to the left ear and the right ear of the user in light of a left speaker of the two speakers, H2L and H2R are HRTFs relating to the left and right ears of the user in light of a right speaker of the two speakers, DF1 is direction function relating to a first signal to be applied to the left speaker, DF2 is direction function relating to a second signal to be applied to the right speaker, and eL and eR are signals reaching both ears of the user by application of the direction functions DF1 and DF2; and dL=PLy*X dR=PRy*X wherein PLy and PRy are HRTFs relating to the left and right ears of the user in light of a pseudo-set speaker, and dL and dR are signals for reaching the sound source X at both ears of the user through the pseudo-set speaker pseudo-set in an arbitrary position y.

7. A reproducing device to reproduce multi-channel audio data by using two speakers, said reproducing device comprising:

a data restorer to decode the multi-channel audio data and restore the multi-channel data of a frequency domain, wherein the multi-channel data comprises left and right main channel audio data, center channel audio data, and stereo surround channel audio data; and a directivity preserving processor to preserve each directivity component of the multi-channel audio data in the frequency domain, and to output the directivity components of the multi-channel audio data, where the directivity preserving processor applies direction functions to corresponding ones of the center channel audio data and the stereo surround channel audio data to produce processed center channel and stereo channel audio data, and combines the processed center channel and stereo channel audio data with the left and right main channel data so as to output directivity preserved first and second main channel audio data to first and second main channels, respectively, corresponding to the two speakers.

8. The reproducing device as claimed in claim 7, further comprising a process domain converter to convert the directivity preserved first and second main channel audio data into audio data of a time domain.

9. The reproducing device as claimed in claim 7, wherein the multi-channel audio data further includes subwoofer channel audio data that is mixed with the directivity preserved first and second main channel audio data.

10. The reproducing device as claimed in claim 7, wherein:

the multi-channel audio data of the frequency domain includes left main channel, right main channel, center channel, and stereo surround audio channel data; and said directivity preserving processor, which has a center channel function, and a stereo surround channel function based on a head related transfer function indicative of a characteristic of frequency variation due to a head of a user for audio signals of center and stereo surround directions, respectively, multiplies the center channel audio data and the stereo surround channel audio data by the center channel and stereo surround channel functions, respectively, mixes the multiplied center channel audio data and the stereo surround channel audio data with the left and right main channel audio data, and to output the directivity-preserved first and second main channel audio data as left and right main channel audio data to the two main channels, respectively.

11. The device as claimed in claim 10, wherein said directivity processor comprises:

a direction function unit comprising the center channel and stereo surround channel direction functions for the center channel audio data and the stereo surround channel audio data, respectively, to multiply the center channel audio data and the stereo surround channel audio data by the corresponding direction functions, and to output the multiplied data as first and second multiplied center channel audio data and as first and second stereo surround channel audio data; and a mixer to mix the left main channel audio data with the first multiplied center channel audio data and the first stereo surround channel audio data to generate the directivity-preserved left main channel audio data, and to mix the right main channel audio data with the second multiplied center channel audio data and the second stereo surround channel audio data to generate the directivity-preserved right main channel audio data.

12. The device as claimed in claim 11, wherein said mixer comprises:

a preprocessor to pre-process the left main channel, right main channel, first and second multiplied center channel, and first and second stereo surround channel audio data, by block switching based upon an algorithm with which, the multi-channel audio data is encoded; and an adding unit to add the preprocessed left main channel audio data, to the preprocessed first multiplied center channel audio data and the preprocessed first stereo surround channel audio data to generate the directivity-preserved left main channel audio data, and adding the preprocessed right main channel audio data, the preprocessed second multiplied center channel audio data, and the preprocessed second stereo surround channel audio data to generate the directivity preserved right main channel audio data.

13. The reproducing device as claimed in claim 8, wherein:

the multi-channel audio data of the frequency domain includes left main channel, right main channel, center channel, and stereo surround audio channel data; and said directivity preserving processor, which has a center channel function and a stereo channel function based on a head related transfer function indicative of a characteristic of frequency variation due to a head of a user for audio signals of center and stereo surround directions, respectively, multiplies the center channel audio data and the stereo surround channel audio data by the first and second center channel and stereo surround channel functions, respectively, and mixes the multiplied center channel audio data and the stereo surround channel audio data channel with the left and right main channel audio data, and to output the directivity-preserved first and second main channel audio data as left and right main channel audio data to the two main channels, respectively.

14. The device as claimed in claim 13, wherein said directivity processor comprises:

a direction function unit comprising the center channel and stereo surround channel direction functions for the center channel audio data and the stereo surround channel audio data, respectively, to multiply the center channel audio data and the stereo surround channel audio data by the corresponding direction functions and to output the multiplied data as first and second multiplied center channel audio data and as first and second stereo surround channel audio data; and a mixer to mix the left main channel audio data with the first multiplied center channel audio data and the first stereo surround channel audio data to generate the directivity-preserved left main channel audio data, and to mix the right main channel audio data with the second multiplied center channel audio data and the second stereo surround channel audio data to generate the directivity-preserved right main channel audio data.

15. The device as claimed in claim 14, wherein said mixer comprises:

a preprocessor to pre-process the left main channel, right main channel, first and second multiplied center channel, and first and second stereo surround channel audio data, by block switching based upon an algorithm with which the multi-channel audio data is encoded; and an adding unit to add the preprocessed left main channel audio data, to the preprocessed first multiplied center channel audio data and the preprocessed first stereo surround channel audio data to generate the directivity-preserved left main channel audio data, and adding the preprocessed right main channel audio data, the preprocessed second multiplied center channel audio data, and the preprocessed second stereo surround channel audio data to generate the directivity preserved right main channel audio data.

16. The device as claimed in claim 7, wherein the directivity preserved first and second main channel audio data are directivity preserved left and right main channel audio data, respectively.

17. A reproducing device to reproduce multi-channel audio data by using two speakers, said reproducing device comprising:

a data restorer to decode the multi-channel audio data and restore the multi-channel data of a frequency domain comprising left and right main channel audio data, center channel audio data, and stereo surround channel audio data; and a directivity preserving processor to preserve each directivity component of the multi-channel audio data in the frequency domain, wherein the multi-channel audio data comprises left and right main channel audio data, center channel audio data, and stereo surround channel audio data, and to output the directivity components of the multi-channel audio data as directivity preserved first and second main channel audio data to first and second main channels, respectively, corresponding to the two speakers, wherein:

the directivity preserved first and second main channel audio data are directivity preserved left and right main channel audio data, respectively;

the multi-channel audio data of the frequency domain includes left main channel, right main channel, subwoofer channel, center channel, and right and left stereo surround channel audio data; and said directivity preserving processor includes:

a direction function unit comprising first and second center channel direction function units to multiply the center channel audio data with first and second center channel direction functions, respectively, to generate first and second multiplied center channel audio data, first and second left surround channel direction function units to multiply the left surround channel audio data with first and second left surround channel direction functions, respectively, to generate first and second multiplied left surround channel audio data, and first and second right surround channel direction function units to multiply the right surround channel audio data with first and second right surround channel direction functions, respectively, to generate first and second multiplied right surround channel audio data; and a mixer to mix the left and right main channel, subwoofer channel, first and second multiplied center channel, first and second multiplied left surround channel, and first and second multiplied right channel audio data, to generate the directivity preserved left and right main channel audio data.

18. The device as claimed in claim 17, wherein the mixer comprises:

a preprocessor to preprocess the left and right main channel, subwoofer channel, first and second multiplied center channel, first and second multiplied left surround channel, and first and second multiplied right channel audio data; and an adding unit including a gain adjuster to gain adjust the preprocessed subwoofer channel audio data, a first adder to add the preprocessed left main channel audio data to the gain adjusted subwoofer channel audio data, to generate a first sum, a second adder to add the preprocessed right main channel data to the gain adjusted subwoofer channel audio data, to generate a second sum, a third adder to add the preprocessed first left surround channel audio data to the first right surround channel audio data, to generate a third sum, a fourth adder to add the preprocessed second left surround channel audio data to the second right surround channel audio data, to generate a fourth sum, a fifth adder to add the preprocessed first center channel audio data to the third sum, to generate a fifth sum, a sixth adder to add the preprocessed second center channel audio data to the fourth sum, to generate a sixth sum, a seventh adder to adder the first and fifth sums, to generate the directivity preserved left main channel audio data, and an eighth adder to adder the second and sixth sums, to generate the directivity preserved right main channel audio data.

19. The device as claimed in claim 17, wherein each of the first and second center channel functions, first and second right surround channel direction functions, and first and second left surround channel direction functions are based upon a head related transfer function (HRTF) which represents a characteristic of frequency variation due to a head of a user in each of right, left, center, left and right surround directions.

20. The device as claimed in claim 8, wherein the directivity preserved first and second main channel audio data are directivity preserved left and right main channel audio data, respectively.

21. The device as claimed in claim 20, wherein:

the multi-channel audio data of the frequency domain includes left main channel, right main channel, subwoofer channel, center channel, and right and left stereo surround channel audio data; and said directivity preserving processor includes a direction function unit comprising:

first and second center channel direction function units to multiply the center channel audio data with first and second center channel direction functions, respectively, to generate first and second multiplied center channel audio data, first and second left surround channel direction function units to multiply the left surround channel audio data with first and second left surround channel direction functions, respectively, to generate first and second multiplied left surround channel audio data, and first and second right surround channel direction function units to multiply the right surround channel audio data with first and second right surround channel direction functions, respectively, to generate first and second multiplied right surround channel audio data; and a mixer to mix the left and right main channel, subwoofer channel, first and second multiplied center channel, first and second multiplied left surround channel, and first and second multiplied right channel audio data, to generate the directivity preserved left and right main channel audio data.

22. The device as claimed in claim 21, wherein the mixer comprises:

a preprocessor to preprocess the left and right main channel, subwoofer channel, first and second multiplied center channel, first and second multiplied left surround channel, and first and second multiplied right channel audio data; and an adding unit including a gain adjuster to gain adjust the preprocessed subwoofer channel audio data, a first adder to add the preprocessed left main channel audio data to the gain adjusted subwoofer channel audio data, to generate a first sum, a second adder to add the preprocessed right main channel data to the gain adjusted subwoofer channel audio data, to generate a second sum, a third adder to add the preprocessed first left surround channel audio data to the first right surround channel audio data, to generate a third sum, a fourth adder to add the preprocessed second left surround channel audio data to the second right surround channel audio data, to generate a fourth sum, a fifth adder to add the preprocessed first center channel audio data to the third sum, to generate a fifth sum, a sixth adder to add the preprocessed second center channel audio data to the fourth sum, to generate a sixth sum, a seventh adder to adder the first and fifth sums, to generate the directivity preserved left main channel audio data, and an eighth adder to adder the second and sixth sums, to generate the directivity preserved right main channel audio data.

23. The device as claimed in claim 21, wherein each of the first and second center channel functions, first and second right surround channel direction functions, and first and second left surround channel direction functions are based upon a head related transfer function (HRTF) which Represents a characteristic of frequency variation due to a head of a user in each of right, left, center, left and right surround directions.

24. A device for reproducing multi-channel audio data by using two speakers, comprising:

a data restorer to decode the multi-channel audio data and restore the multi-channel audio data of a frequency domain, the multi-channel audio data of the frequency domain including left main channel, right main channel, subwoofer channel, center channel, and stereo surround channel audio data;

a directivity preserving processor comprising a center channel direction function and a stereo surround channel direction function based on a head related transfer function indicative of a characteristic of frequency variation due to a head of a user for audio signals of center and stereo surround directions, to multiply the center channel audio data and the stereo surround channel audio data by the center channel and stereo surround channel direction functions, respectively, and mix the multiplied center channel audio data and the stereo surround channel audio data with the left and right main channel audio data and the subwoofer channel audio data, and to output directivity-preserved left and right main channel audio data to two main channels; and a process domain converter to convert the directivity-preserved left and right main channel audio data into audio data of a time domain.

25. The device as claimed in claim 1, wherein said directivity processor comprises:

a direction function unit comprising the center channel and stereo surround channel direction functions for the center channel audio data and the stereo surround channel audio data, respectively, to multiply the center channel audio data and the stereo surround channel audio data by the corresponding direction functions and to output the multiplied data as first and second multiplied center channel audio data and as first and second stereo surround channel audio data; and a mixer to mix the left main channel audio data with subwoofer channel audio data, the first multiplied center channel audio data and the first stereo surround channel audio data to generate the directivity-preserved left main channel audio data, and the right main channel audio data with subwoofer channel audio data, the second multiplied center channel audio data and the second stereo surround channel audio data to generate the directivity-preserved right main channel audio data.

26. The device as claimed in claim 2, wherein said mixer comprises:

a preprocessor to pre-process the left main channel, right main channel, subwoofer channel, first and second multiplied center channel, and first and second stereo surround channel audio data, by block switching based upon an algorithm with which the multi-channel audio data is encoded; and an adding unit to add the preprocessed left main channel audio data to the subwoofer channel audio data, the preprocessed first multiplied center channel audio data and the preprocessed first stereo surround channel audio data to generate the directivity-preserved left main channel audio data, and to add the preprocessed right main channel audio data to the subwoofer channel audio data, the preprocessed second multiplied center channel audio data and the preprocessed second stereo surround channel audio data to generate the directivity preserved right main channel audio data.

27. A method for reproducing multi-channel audio data by using two speakers, comprising the steps of:

decoding the multi-channel audio data and restoring the decoded multi-channel audio data of a frequency domain;

obtaining a center channel direction function and a stereo surround channel direction function based upon a head related transfer function indicative of a characteristic of frequency variation due to a head of a user for audio signals of center and stereo surround directions, and applying the obtained center channel direction function and stereo surround channel direction function to center channel and stereo surround channel-audio data of the multi-channel audio data, respectively;

mixing the center channel audio data and the stereo surround channel audio data to which the center channel and stereo surround channel direction functions are applied, with left and right main channel audio data and subwoofer channel audio data, to generate directivity-preserved left and right main channel audio data to two main channels; and converting the directivity-preserved left and right main channel audio data into audio data of a time domain.

28. The reproducing device as claimed in claim 7, wherein:

the multi-channel audio data of the frequency domain includes left main channel, right main channel, subwoofer channel, center channel, and stereo surround channel audio data; and said directivity preserving processor has a center channel function and a stereo channel function based on a head related transfer function indicative of a characteristic of frequency variation due to a head of a user for audio signals of center and stereo surround directions, respectively, to multiply the center channel audio data and the stereo surround channel audio data by the center channel and stereo surround channel functions, respectively, to mix the multiplied center channel audio data and the stereo surround channel audio data with the left and right main channel audio data and the subwoofer channel audio data, and to output the directivity-preserved first and second main channel audio data as left and right main channel audio data to the two main channels, respectively.

29. The device as claimed in claim 10, wherein:

the multi-channel audio data of the frequency domain further comprises subwoofer channel audio data, and the directivity processor comprises:

a direction function unit comprising the center channel and stereo surround channel direction functions for the center channel audio data and the stereo surround channel audio data, respectively, to multiply the center channel audio data and the stereo surround channel audio data by the corresponding direction functions and to output the multiplied data as first and second multiplied center channel audio data, and first and second stereo surround channel audio data; and a mixer to mix the left main channel audio data with the subwoofer channel audio data, the first multiplied center channel audio data and the first stereo surround channel audio data to generate the directivity-preserved left main channel audio data, and the right main channel audio data with the subwoofer channel audio data, the second multiplied center channel audio data and the second stereo surround channel audio data, to generate the directivity-preserved right main channel audio data.

30. A device for reproducing multi-channel audio data by using two speakers, comprising:

a data restorer to decode the multi-channel audio data and restore the multi-channel audio data of a frequency domain, the multi-channel audio data of the frequency domain including left main channel, right main channel, center channel, and stereo surround channel audio data;

a directivity preserving processor comprising a center channel direction function and a stereo surround channel direction function based on a head related transfer function indicative of a characteristic of frequency variation due to a head of a user for audio signals of center and stereo surround directions, to mix the center channel audio data and the stereo surround channel audio data multiplied by the center channel and stereo surround channel direction functions with the left and right main channel audio data, and to output directivity-preserved left and right main channel audio data to two main channels; and a process domain converter to convert the directivity-preserved left and right main channel audio data into audio data of a time domain.

31. The method of claim 5, wherein said mixing to generate the directivity-preserved left and right main channel audio data further comprises receiving the left and right main channel audio data, where a direction function is not applied to one of the left and right main channel audio data.

32. The method of claim 5, wherein:

said decoding and restoring comprises restoring the left and right main channel audio data, said applying the obtained center channel direction function and the stereo surround channel function produces first and second applied center channels and first and second applied stereo surround channels, and said mixing to generate the directivity-preserved left and right main channel audio data further comprises receiving the left and right main channel audio data, and mixing the left and right main channels with the first and second applied center channels and the first and second applied stereo surround channels to produce the directivity-preserved left and right main channel audio data.

33. The reproducing device of claim 7, wherein said directivity preserving processor does not produce directivity components of the left and right main channel audio data and mixes the left and right main channel data with the directivity components of ones of the remaining channels of the multi-channel audio data to output the directivity preserved first and second main channel audio data.

* * * * *